US007260866B2

(12) United States Patent
Hubbard

(10) Patent No.: US 7,260,866 B2
(45) Date of Patent: Aug. 28, 2007

(54) DEVICE FOR CLEARING RAIN GUTTERS

(76) Inventor: Barry Hubbard, 510 Manor Ridge Dr., Atlanta, GA (US) 30305

( * ) Notice: Subject to any disclaimer, the term of this patent is extended or adjusted under 35 U.S.C. 154(b) by 672 days.

(21) Appl. No.: 10/259,030

(22) Filed: Sep. 27, 2002

(65) Prior Publication Data

US 2004/0060142 A1 Apr. 1, 2004

(51) Int. Cl.
*A47L 13/02* (2006.01)
*A47L 13/08* (2006.01)

(52) U.S. Cl. ..... 15/236.04; 15/236.01

(58) Field of Classification Search ..... 15/104.3, 15/104.05, 104.068, 104.16, 236.01, 236.04, 15/236.07, 236.09; 294/50.6, 50.8, 50.9, 294/55, 53.5; 401/9; 56/333, 334; 30/171
See application file for complete search history.

(56) References Cited

U.S. PATENT DOCUMENTS

| | | | | | |
|---|---|---|---|---|---|
| 725,480 | A | * | 4/1903 | Price | 15/144.1 |
| 1,253,284 | A | * | 1/1918 | Schoener | 172/372 |
| 1,572,824 | A | * | 2/1926 | Tatge | 37/283 |
| 2,713,206 | A | * | 7/1955 | Zelnick | 403/101 |
| 3,858,267 | A | | 1/1975 | Swannie | |
| 4,057,276 | A | | 11/1977 | Currie | |
| 4,298,224 | A | | 11/1981 | Hansen et al. | |
| 4,304,498 | A | | 12/1981 | George | |
| 4,310,940 | A | | 1/1982 | Moore | |
| 4,424,997 | A | * | 1/1984 | Jackson | 294/53.5 |
| 4,502,806 | A | | 3/1985 | Albertson | |
| 4,542,553 | A | | 9/1985 | Cary | |
| 4,726,090 | A | | 2/1988 | Kilpatrick | |
| 4,848,818 | A | | 7/1989 | Smith | |
| 5,288,118 | A | | 2/1994 | Hartselle, III | |
| 5,382,065 | A | * | 1/1995 | Snell | 294/53.5 |
| 5,435,612 | A | | 7/1995 | Kreiser | |
| 5,626,377 | A | | 5/1997 | Carroll, Jr. et al. | |
| 5,853,209 | A | | 12/1998 | McDermott | |
| 5,855,402 | A | | 1/1999 | Maraschiello | |
| 5,898,969 | A | | 5/1999 | Middleton | |
| 5,988,715 | A | | 11/1999 | Mason | |
| 6,029,998 | A | * | 2/2000 | Woodard | 280/819 |
| 6,139,077 | A | | 10/2000 | Molzan, II | |
| 6,209,937 | B1 | | 4/2001 | Keiter | |
| 6,237,974 | B1 | | 5/2001 | Chisholm | |
| 6,257,256 | B1 | | 7/2001 | Fischer | |
| 6,526,619 | B1 | * | 3/2003 | Cassels, Jr. | 15/236.04 |

* cited by examiner

*Primary Examiner*—Terrence R. Till
(74) *Attorney, Agent, or Firm*—Gardner Groff Greenwald & Villanueva, P.C.

(57) ABSTRACT

A gutter-clearing tool having a scoop-plate and a top-plate where the front end of the top-plate is pivotally attached to the top end of the scoop-plate, and the top plate is attached to a rod. A pivot joint allows the scoop-plate to close upwardly toward the top plate when the apparatus is pushed through the gutter thereby providing a substantially reduced vertical profile, and allows the scoop-plate to open downwardly away from the top plate when the apparatus is pulled through the gutter thereby collecting debris and clearing the gutter.

5 Claims, 4 Drawing Sheets

DEVICE FOR CLEARING RAIN GUTTERS

TECHNICAL FIELD

The present invention relates generally to a device for clearing eaves and gutters from debris, including leaves, roofing material, and other debris from the eaves and gutters.

BACKGROUND OF THE INVENTION

For centuries gutters and downspouts have been installed on buildings in order to properly channel to the ground the water running off of building roofs. Without a gutter, the considerable amount of run-off water from a roof would haphazardly barrage the ground immediately below the roof edge, producing either unsightly eroded trenches or depressed marshy areas, and potentially damaging a building's foundation and/or flooding the basement. Gutters, on the other hand, when operating efficiently, promote effective drainage of the roof run-off water without these deleterious effects.

There are, unfortunately, several problems commonly associated with gutters. Not only does a gutter serve as a collection channel for water, but also for debris, such as leaves, sticks, roofing material and the like, which might be either blown onto a roof or deposited thereon by an overhanging tree. Deposited debris acts as a dam in the gutter and tends to preclude the water contained in the gutter from reaching a downspout. In this situation, the water either stagnates in the gutter or collects to the extent that it haphazardly overflows the gutter, thereby causing the same deleterious effects described above.

It is at least an annual chore in most locations, especially where there are trees of any size, to remove the leaves, sticks and other debris that accumulate in gutters of the type commonly used on residences. This material must be removed in order to permit the proper drainage of the water received from the adjacent roof in order to prevent overflow, thereby defeating the purpose of the gutters. Further, with many gutters, particularly steel gutters, it is desirable that the drainage be free or unblocked in order to eliminate rusting.

The aforesaid gutters are normally maintained in position by means of gutter spikes, ferrules or clips, which are secured to the roof. In either event, these clips, ferrules and spikes interfere with the cleaning process. Homeowners use various tools, such as trowels, spatulas and the like, for this generally disagreeable task.

In order to successfully clear the gutters it is usually necessary to either approach the gutter from the roof, or to approach it from a ladder. One typically must get the tool under the spikes, ferrules or clips in order to successfully reach the debris and be sure that the bottom of the gutter is clear. Further, it is desirable that the user be able to view the tool as it is moved along the trough of the gutter. Some attempts have been made nonetheless to provide tools, which can be used by the homeowner while he is on the ground adjacent the side of the home. These tools typically include elongated links of tubes or the like and require operation of the tool from the end of a tool handle while preventing observation of the gutter itself. It is usually impossible for an operator to ascertain the location and quantity of debris deposited in a gutter unless he first ascends to the building roof for an inspection. Tools manipulated from the ground rely on the operator's ability to "feel" the debris in the overhead gutter. Often, however, such guesswork is inaccurate and inefficient. Additionally, as a portion of this kind of tool rests on the exterior of the gutter, damage to the gutter's exterior is possible. Furthermore, such tools are cumbersome because of their length and it is unlikely that they are in extensive use.

A gutter-clearing tool mounted on an elongated handle may be difficult to operate if the tool is bulky or heavy. For example, a blade may be attached to a rod, and the blade may be passed under the gutter spikes, clips or ferrules in a forward motion and away from the user, and then pulled backward and toward the user, hopefully clearing debris along the way. Unfortunately, while passing the blade forward, debris will be pushed forward, and away from the user, thereby defeating the purpose of the tool. Additionally, if there is a substantial amount of debris in the gutter trough, debris will pass over the top of the blade and fall behind the path of the blade while pulling the tool toward the user, once again defeating the purpose of the tool by leaving this "overflow" debris in the wake of the tool.

Some clearing tools compound the difficulty by providing a handle to be held in one hand and a tool-controlling rope, or pulley, which must be held in the other hand. Devices of this type necessitate an undue degree of operator agility, strength, and balance.

Therefore, it can be seen that needs exist for an improved gutter-clearing tool. It is to the provision of a tool meeting this and other needs that the present invention is primarily directed.

SUMMARY OF THE INVENTION

The present invention is an improved device for the clearing of debris from gutters, and the like. The apparatus of the present invention preferably "closes" or decreases its profile while traveling away from the user or being pushed through the gutter and "opens" or increases its vertical profile upon return or being pulled through the gutter, thereby allowing the device to travel over the debris when being pushed, and collect and "drag" or "clear" the debris when being pulled.

An example embodiment of the device of the present invention has a scoop-plate, which is pivotally attached to a top plate. In turn, the top-plate is attached to a rod. The pivot is located at the top of the scoop-plate and at the front end of the top-plate. When the device is pushed down the gutter, this pivot allows the device to "close" thereby reducing the vertical profile of the device and avoiding the device from pushing debris further down the gutter as well as assisting in avoiding "jamming" or "hanging up" the device in the gutter due to the debris, the gutter spikes or a combination thereof. When the device is pulled through the gutter, the pivot allows the scoop-plate to open, downward from the top plate, so that it is substantially perpendicular to the bottom of the gutter trough.

Generally described, in another aspect, the invention is an apparatus for clearing debris from gutters, the apparatus preferably comprising a rod, a top-plate and a scoop-plate. The rod is attached at its front end to the back end of the top-plate. A pivot joint is located at the top of the scoop-plate, pivotally affixing the front end of the top-plate to the scoop-plate. The pivot joint may limit the range of motion so that the maximum pivot angle is about 120 degrees radian from the top plate. Alternatively, this range of motion may be limited to about 90 degrees radian from the top plate. A minimum angle associated with the pivot joint may be about zero degrees radian between the top-plate and the scoop-plate. To accomplish the aforementioned range of motion a rule joint may be utilized in particularly preferred embodiments. Additionally a handle may optionally be attached to the back end of the rod for ease of use.

Sidewalls may optionally be utilized on the left side and right side the scoop-plate, which preferably run between the top and the bottom of the scoop plate. These sidewalls may assist in pulling the debris along the trough and avoid the debris from spilling past the sides of the apparatus. Also to assist in the avoidance of "spilling" of the debris, the bottom of the scoop plate may be substantially flat.

An alternative embodiment of the apparatus of the present invention preferably comprises a scoop-plate having a top and bottom end, a top-plate and a rod, each having a front and back end. Again, the scoop-plate preferably is pivotally attached to the top-plate along the their respective top and front ends. The rod preferably is attached at its front end to the back end of the top-plate. The pivot preferably allows the scoop-plate to close upwardly toward the top plate when the apparatus is pushed through the gutter thereby providing a reduced vertical profile. The height of this reduced profile is preferably at least 25%, less than the open profile, and more preferably is at least 50% less than the open profile. Additionally, the pivot joint preferably allows the scoop-plate to open downwardly away from the top plate when the apparatus is pulled through the gutter, thereby allowing the bottom end of the scoop plate to contact the gutter trough. The pivot joint preferably limits the opening of the scoop-plate so that it is held substantially perpendicular to the bottom surface of the gutter when the apparatus is pulled through the gutter. To assist in debris clearing, the bottom of the scoop-plate is preferably substantially flat. Additionally, sidewalls may be utilized on the scoop-plate, to assist in the clearing of the debris, on the right and left sides of the scoop-plate, each running substantially from the top end to the bottom end of the scoop-plate.

In yet another embodiment of the invention, the apparatus preferably comprises a scoop-plate, a top-plate and a rod. The scoop plate preferably has a top end, a bottom end, wherein the bottom end is substantially flat and substantially the same width as the inner width of the gutter to be cleared. The scoop plate additionally has a left sidewall and a right sidewall, each sidewall substantially traversing from the top end to the bottom, wherein the sides comprise walls extending substantially perpendicular from the scoop plate. The top plate preferably has a front and a back end, and the front end is pivotally attached to the top end of the scoop plate. The rod has a front and back end and is attached at the front end to the back end of the top plate. The pivot preferably has a range of motion that limits the range of motion of the scoop-plate so that when pivoted open, the scoop plate is substantially perpendicular to the gutter trough. Additionally this pivot's range of motion preferably allows for the scoop-plate to close, in respect to the top-plate, and be substantially parallel to the top-plate. To assist in the user's reach, it may be preferable to have the rod of certain minimum lengths, such as three or six feet long. Additionally, it may be preferable to have the pivot be a rule joint as well as adding a handle to the rod.

In still yet another embodiment, the tool for clearing debris from a gutter has a rod and a scoop-plate. The scoop-plate has a left and a right side as well as a top and a bottom edge. The top of the scoop plate is pivotally attached to the rod so that when the tool moves in a first direction, preferably away from the user, the tool pivots into an open position when the tool moves in a second direction. This pivot may preferably be a rule joint. Additionally, it may be preferable for the bottom edge of the scoop-plate to be substantially flat. Additionally, as before, it is preferable for the right and left sides of the scoop plate to have sidewalls that extended substantially perpendicular from said scoop plate.

DETAILED DESCRIPTION OF THE EMBODIMENTS

Figure 1:
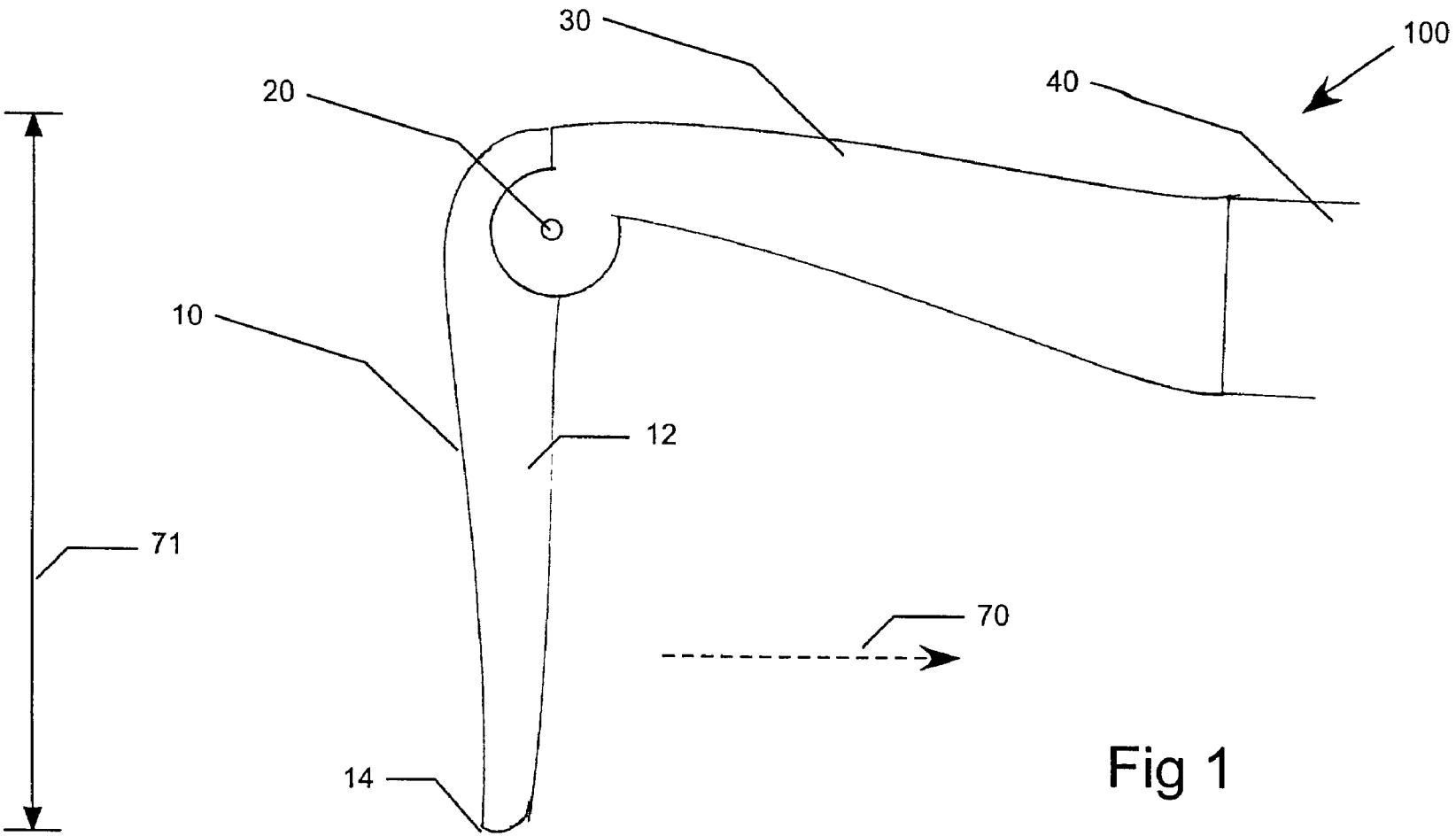
FIG. 1 is a side view of an embodiment of the gutter-clearing tool of the present invention in the "open" or "pulling" state.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about" or the like, it will be understood that the particular value forms another embodiment.

In an example embodiment, the tool 100 of the present invention preferably comprises three separately fabricated parts 10, 30, 40, but one skilled in the art will appreciate that these parts may be fabricated either as a single part or two parts. The parts may be made of a light-weight but strong polymer such as polyethylene or polypropylene. Alternative compositions include metal, wood and other plastics and hard rubber.

A rod 40 is preferably made of a flexible yet durable material, such as polyethylene or polypropylene. The rod 40 is preferably attached permanently, or detachably, depending on the user's or designer's preference. This rod 40 is preferably attached to a top-plate 30, which is in turn pivotally attached to the scoop-plate 10. The rod 40 is preferably a rod 40 that is easily grasped by a user, but can be any extension type of piece, include rods of round, rectangular and other cross-sections, and varying shapes and angles. The rod 40 is preferably of a sufficient length to allow significant reach, while avoiding making the tool unwieldy. For example, the typical user's reach may be three feet. Therefore, with a six foot length of the tool 100, in which the rod 40 is preferably a substantial part, the total reach of the user in each direction is nine feet, allowing a total reach, in both directions of the gutter 50, of eighteen feet, which reduces the number of ladder placements, if "attacking the gutters" from the ground, or the number of times the user must approach the gutter 50, and the precarious edge of the roof 62, when "attacking the gutters" from the roof 62.

The scoop plate 10 may be generally shovel-shaped, rounded, flat, or any configuration conducive to gutter debris clearing in relation to the present invention. Sidewalls 12 may be utilized to facilitate such clearing to assist in preventing "spill over" of the debris on the sides of the tool. Another way to limit the spill over along the sides is to have the width of the apparatus just slightly less than the inner width of the gutter trough 54, thereby limiting the space that such could allow for such a spill-over to happen.

The term gutter 50 includes gutters, as well as eaves and any like kind trough that may collect debris located on structures.

The pivot joint 20, while preferably a rule joint, may include any type of joint that allows the top-plate 30 and scoop-plate 10 to pivot or "open and close" in relation to one another. The device 100 of the present invention preferably allows the vertical profile 71, 73 of the apparatus to reduce while being pushed through the trough of the gutter. This vertical profile 71, 73 is the "height" of the profile of the apparatus and alternates between open and closed position depending on the direction of travel of the apparatus. The pivot joint 20 may be a hinge or metal rod, placed through molded or otherwise formed channels through the top-plate 30 and the scoop-plate 10, such as a rule joint, or another pivoting means, which allows the pivoting of the scoop-plate 10 and the top-plate 30, including hinges, spring mechanisms and the like.

Figure 2:
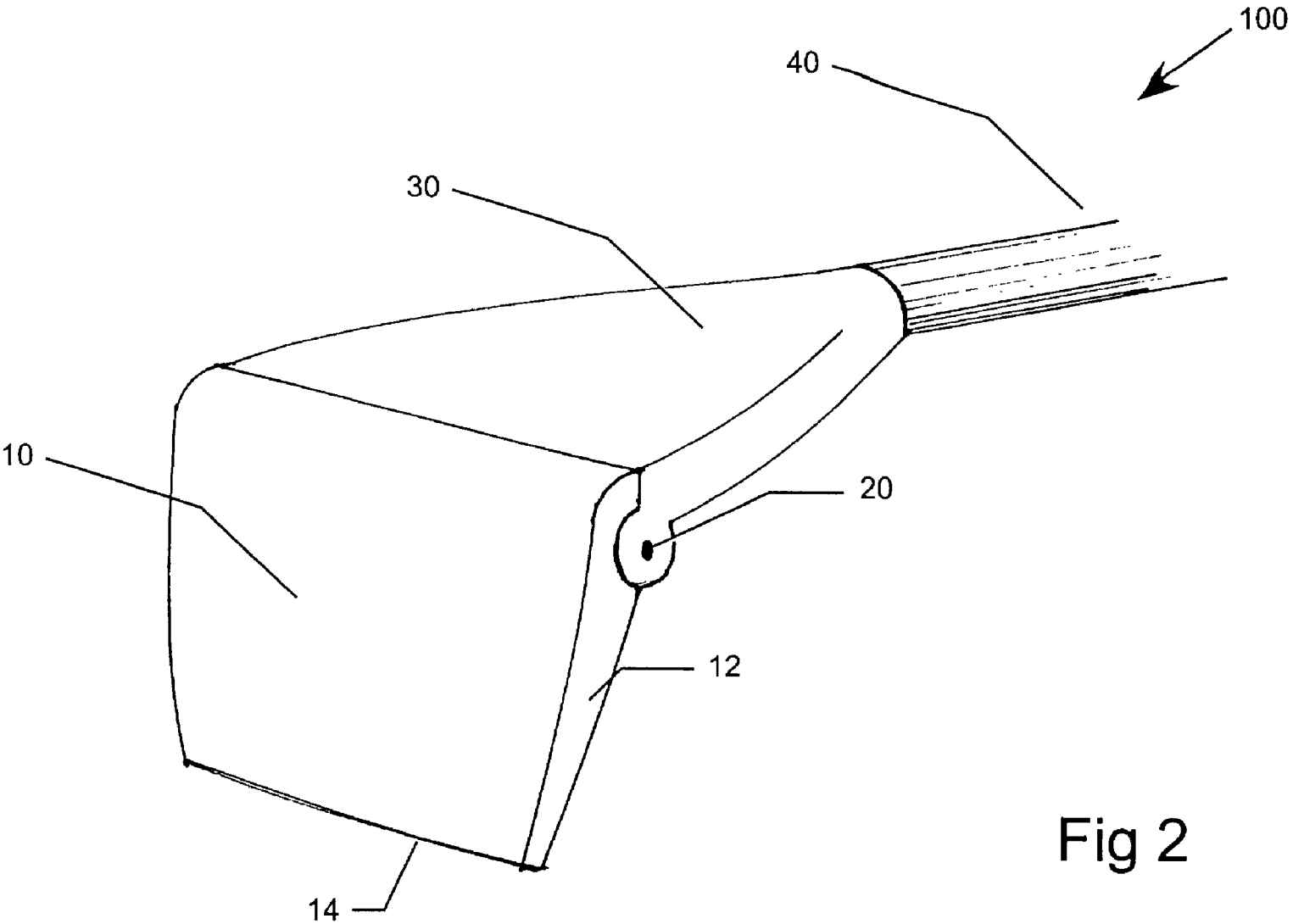
FIG. 2 is a perspective view of an embodiment of the gutter-clearing tool of the present invention in the "open" or "pulling" state.

As shown in FIG. 1, a preferred embodiment of the gutter-clearing tool 100 of the present invention comprises a scoop-plate 10 having a scoop-plate bottom edge 14 which will be used to traverse or scrape along the bottom of the gutter trough. The scoop-plate 10 preferably also has scoop-plate sidewalls 12, which run upward from the scoop-plate bottom edge 14 toward the pivot vent 20 at the top edge of the scoop-plate 10. The front side of the top-plate 30 is pivotally attached at the pivot joint 20, and is attached at its back end to the front end of the rod 40. The pivot joint 20, in the depicted embodiment is preferably a rule joint. As shown in FIG. 1, the gutter tool 100 is in an open state that would result if the device is pulled to the right, which is indicated as the pull direction 70. In example embodiments, the position of the scoop plate 10 is limited to an angle of less than 120 degrees relative to the elongate rod 40 when the gutter tool 100 is in an open state. This provides a substantial open vertical profile 71, assisting in the clearing of debris. FIG. 2 is a perspective view of the present invention once again showing the tool 100 in an open state. In preferred example embodiments, as shown in FIG. 2, the front side of the top-plate 30 is wider than the rear side of top plate, such that the profile of the top-plate narrows as it approaches the elongate rod 40.

Figure 3:
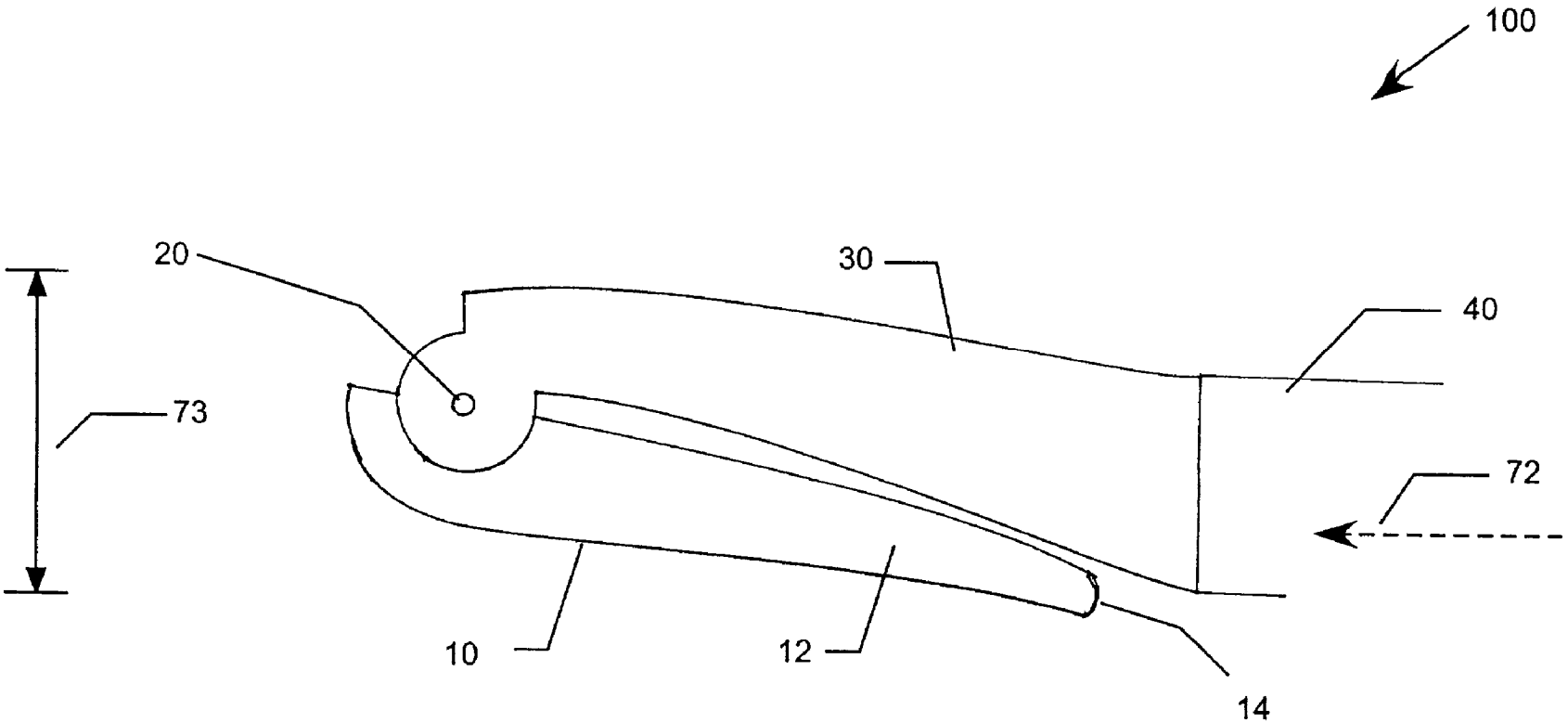
FIG. 3 is a side view of an embodiment of the gutter-clearing tool of the present invention in the "closed" or "pushing" state.

FIG. 3 is a side view of an example embodiment of the gutter-clearing tool 100 in a closed state. This closed state would be typically result when pushing the tool 100 toward the scoop plate, which is the push direction 72 depicted in FIG. 3. This closed state provides a reduced closed vertical profile 73 as compared to the open vertical profile 71 as seen in FIG. 1.

Figure 4:
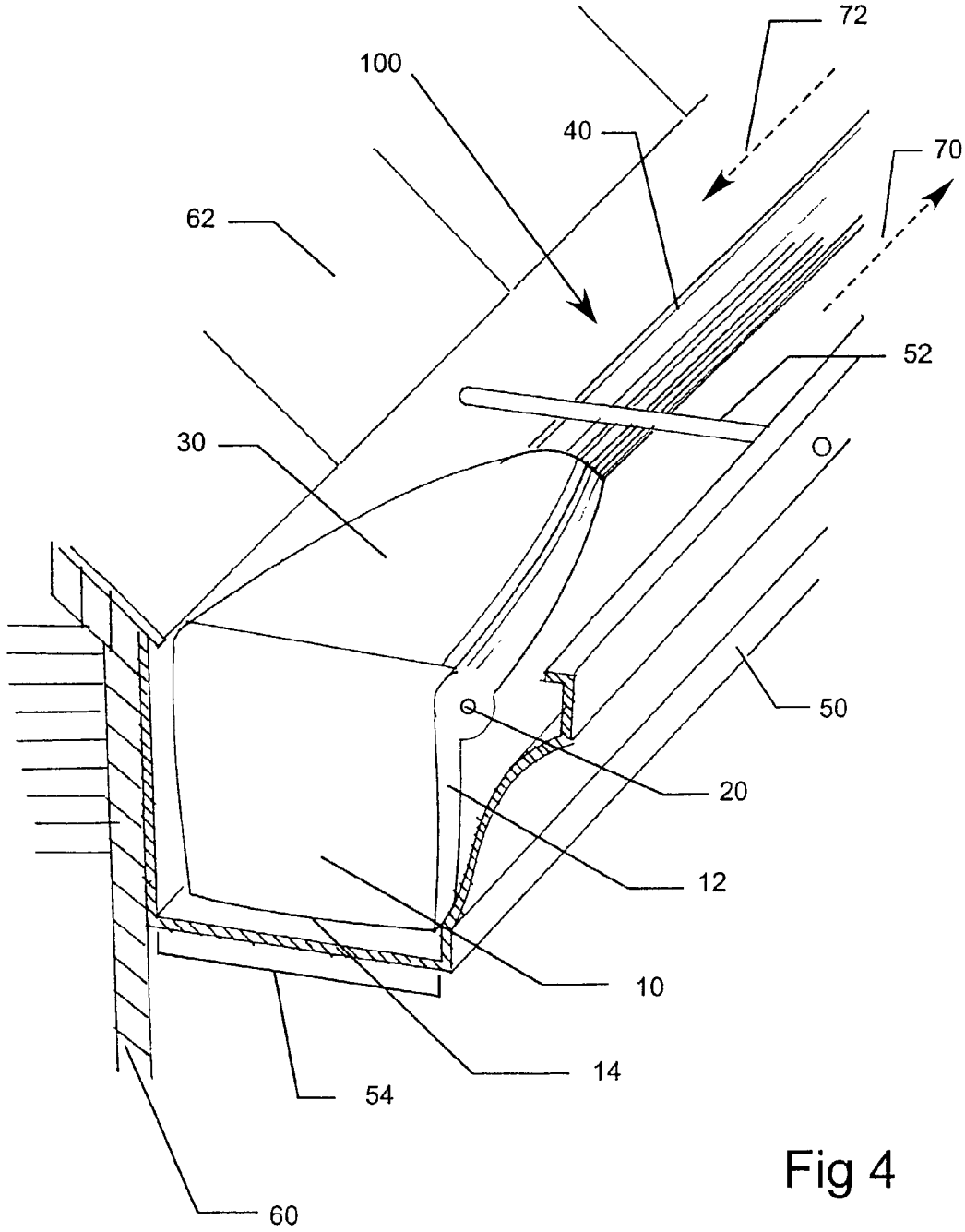
FIG. 4 is a perspective view of an embodiment of the gutter-clearing tool of the present invention in the "open" or "pulling" state while in a house gutter.

As shown in FIG. 4, when utilized within a typical gutter 50, which is located adjacent to the roof 62 of a house 60, the gutter-clearing tool 100 is positioned within the gutter trough 54, and under the gutter spike 52, preferably by moving the tool 100 in the push direction 72. As discussed above, the reduced profile in the push direction 72 reduces the pushing forward of debris in the gutter. Then, as the tool 100 is moved in the pull direction 70, the scoop plate opens to present an increased profile, thereby clearing the debris due to the contact of the scoop-plate bottom 14 with the gutter trough 54.

In view of the foregoing, it will be appreciated that the present invention avoids the drawbacks of prior gutter clearing tools by providing a tool that opens and closes in respect to the direction of motion, allowing easy passage over debris and under gutter spikes while being pushed down a gutter trough, yet opens up and clears debris when being pulled back through the gutter. The specific techniques and structures employed by the invention to improve over the drawbacks of prior gutter clearing tools and to accomplish the advantages described above will become apparent from the above detailed description of the embodiments of the invention and the appended drawings and claims. It should be understood that the foregoing relates only to the exemplary embodiments of the present invention, and that numerous changes may be made therein without departing from the spirit and scope of the invention as defined by the following claims.

The invention claimed is:

1. An apparatus for clearing debris from gutters, the apparatus comprising:

an elongate rod; and a scoop-plate coupled to the elongate rod, and pivotal between a closed position substantially aligned with the elongate rod, and an open position substantially perpendicular to the elongate rod, pivotal motion of said scoop plate being limited by a mechanical stop to prevent motion beyond said open position, wherein the angle between said scoop-plate and said elongate rod is less than about 15 degrees in the closed position, and wherein the pivotal motion of the scoop plate in the open position is limited to an angle of less than 120 degrees relative to the elongate rod, and wherein said scoop-plate has a width substantially equal to an interior width of the gutter to be cleared and wherein a bottom edge of the scoop plate is substantially flat.

2. An apparatus for clearing debris from gutters, the apparatus comprising:

an elongate rod; and a scoop-plate coupled to the elongate rod, and pivotal between a closed position substantially aligned with the elongate rod, and an open position substantially perpendicular to the elongate rod;

wherein the scoop plate is coupled to the elongate rod via an intermediate top plate, the top plate having a first end rigidly connected to the elongate rod, and a second end hingedly coupled to the scoop plate; and wherein the apparatus further comprises a rule joint pivotally connecting said scoop plate to said top plate, said rule joint comprising a first shoulder formed on said scoop plate and a second shoulder formed on said top plate, said first and second shoulders abutting one another to limit pivotal movement of the scoop plate at its open position.

3. An apparatus for clearing debris from gutters, the apparatus comprising:

an elongate rod;

a scoop-plate coupled to the elongate rod, and pivotal between a closed position substantially aligned with the elongate rod, and an open position substantially perpendicular to the elongate rod, pivotal motion of said scoop plate being limited by a mechanical stop to prevent motion beyond said open position; and sidewalls extending rearwardly from each lateral edge of said scoop-plate, wherein the angle between said scoop-plate and said elongate rod is less than about 15 degrees in the closed position, and wherein the pivotal motion of the scoop plate in the open position is limited to an angle of less than 120 degrees relative to the elongate rod.

4. A tool for clearing debris from a gutter comprising:

a rod, having a front end and a back end;

a scoop-plate having;

a left and right side;

a bottom edge, and a top, wherein the top is pivotally attached to said rod by a pivot joint, wherein the pivot joint allows the scoop-plate to pivot into a closed position when the tool moves in a first direction and pivot into an open position when the tool moves in a second direction;

wherein said pivot joint is a rule joint comprising a first shoulder and a second shoulder, said first and second shoulders abutting one another to limit pivotal motion of the scoop plate in its open position; and wherein the bottom edge of said scoop plate is substantially flat.

5. A tool for clearing debris from a gutter comprising:

a rod, having a front end and a back end;

a scoop-plate having;

a left and right side;

a bottom edge, and a top, wherein the top is pivotally attached to said rod by a pivot joint, wherein the pivot joint allows the scoop-plate to pivot into a closed position when the tool moves in a first direction and pivot into an open position when the tool moves in a second direction;

wherein said pivot joint is a rule joint comprising a first shoulder and a second shoulder, said first and second shoulders abutting one another to limit pivotal motion of the scoop plate in its open position; and wherein the left and right side have sidewalls, extending substantially perpendicular from said scoop plate.

* * * * *